United States Patent [19]

Mihara

[11] Patent Number: 4,760,874

[45] Date of Patent: Aug. 2, 1988

[54] METHOD AND APPARATUS FOR FORMING DISK WHEEL LIKE FORMED PARTS

[75] Inventor: Takeshi Mihara, Ube, Japan

[73] Assignee: UBE Industries, Ltd., Japan

[21] Appl. No.: 23,820

[22] Filed: Mar. 9, 1987

[30] Foreign Application Priority Data

Apr. 16, 1986 [JP] Japan ..... 61-86078
Apr. 16, 1986 [JP] Japan ..... 61-86079
Dec. 1, 1986 [JP] Japan ..... 61-284219

[51] Int. Cl.[4] ..... B22D 17/32

[52] U.S. Cl. ..... 164/457; 164/113; 164/305

[58] Field of Search ..... 164/305, 410, 312, 113, 164/253, 155, 157, 457; 425/420, 812

[56] References Cited

U.S. PATENT DOCUMENTS 4,660,620 4/1987 Ozeki ..... 164/155

FOREIGN PATENT DOCUMENTS 1302161 5/1970 Fed. Rep. of Germany ..... 164/113
59-197369 11/1984 Japan ..... 164/457

*Primary Examiner*—Kuang Y. Lin
*Attorney, Agent, or Firm*—Darby & Darby

[57] ABSTRACT

There are disclosed a method and an apparatus for forming disk wheel like formed parts, in a manner that the forming work is carried out by placing, in the vertical direction, the mold axis of a metal mold cavity, which corresponds to the axis of rotation of a disk wheel, thus to inject hot molten metal from the bottom in the mold axis direction, characterized in that the control mode of the injection speed comprises: a first phase to allow an injection speed when the hot molten metal has reached the inlet of the metal mold cavity to be low, a second phase to allow an injection speed from the time when the hot molten metal passes a disk wheel hub equivalent portion of the metal mold cavity until it passes the greater part of a disk wheel rim portion thereof via a disk wheel disk portion thereof to be, at the end portion of said rim equivalent portion, equal to a speed corresponding to a lower speed or less, which corresponds to a gas discharge ability of a degassing unit provided in association with the metal mold, and a third phase to close a discharge valve of the degassing unit after the hot molten metal has passed the greater part of the rim equivalent portion to continuously carry out injecting operation, thus allowing the hot molten metal to be completely filled up into the metal mold cavity. Thus, this permits gas within the metal mold cavity to be effectively discharged at any time without causing gas to be involved into hot molten metal, thus making it possible to easily provide nest-free, high quality formed parts.

6 Claims, 18 Drawing Sheets

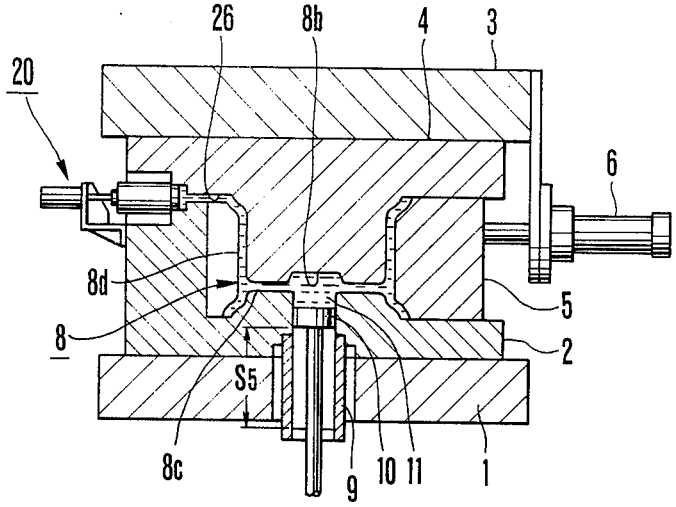
FIG.5 (d)
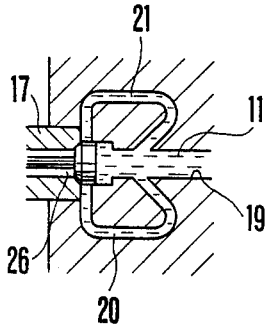
FIG.5 ($d_1$)

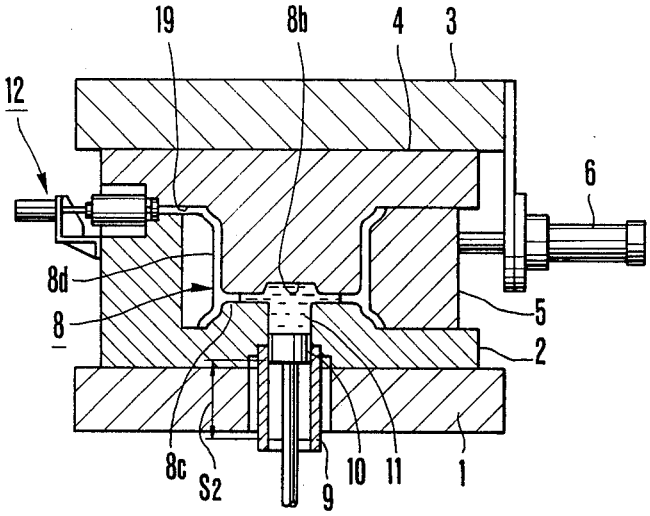
FIG.9 (b)
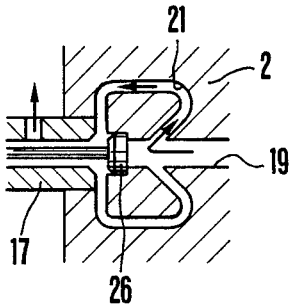
FIG.9 (b1)

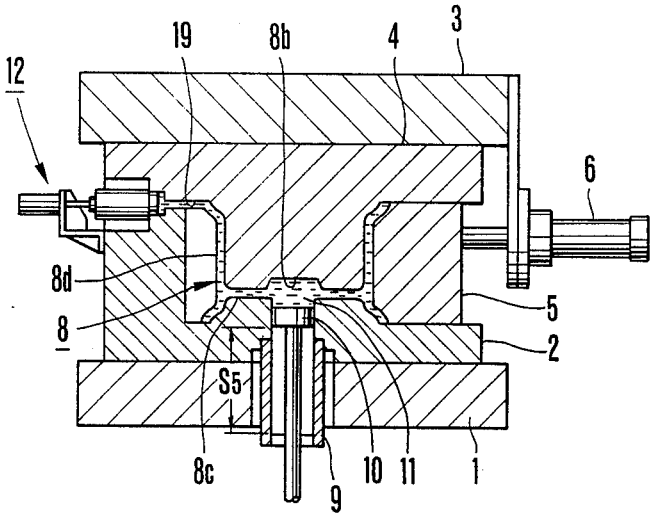
FIG.9 (e)
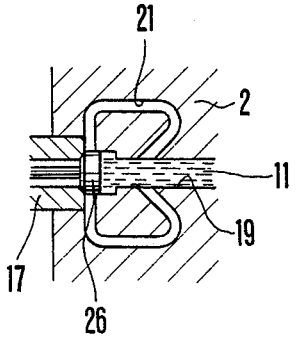
FIG.9 (e1)

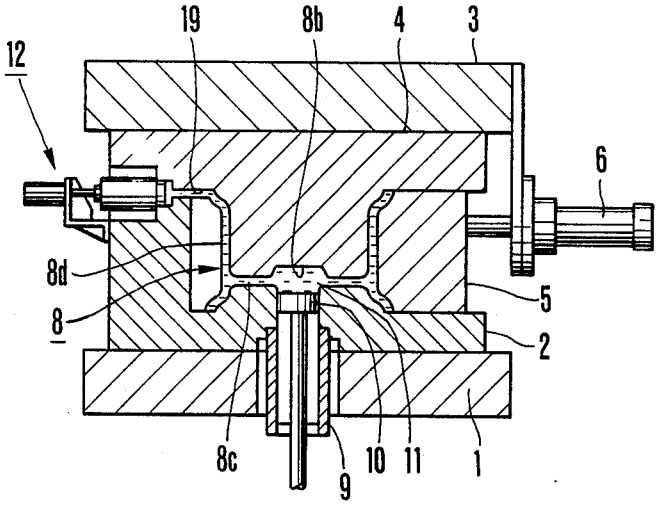
FIG.9(f)
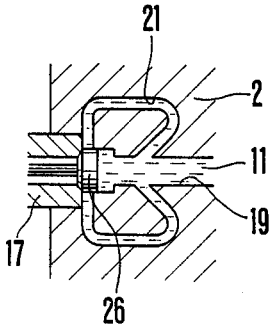
FIG.9 ($f_1$)

METHOD AND APPARATUS FOR FORMING DISK WHEEL LIKE FORMED PARTS

BACKGROUND OF THE INVENTION

The present invention relates to a method and an apparatus for forming a disk-wheel like formed parts using a vertical die casting machine or a vertical squeeze casting machine.

For example, casting works for aluminum disk wheels for automotive vehicles are very often carried out using the vertical die casting machine because of less involvement of gas at the time when hot molten metal is injected or for any other reason. FIG. 1 is a longitudinal cross sectional view schematically showing a metal mold and an injection unit provided in a die casting machine of this kind which has been used in the art. Such a conventional die casting machine will be described in conjunction with this figure. Onto a fixed platen 1 fixed on the machine base, a fixed metal mold 2 having a cylindrical projection in its central portion is affixed. Onto a movable platen 3 supported by a mold clamp cylinder (not shown) to move upwardly and downwardly, a movable metal mold 4 having a low projection in its central portion is affixed. A plurality of cores 5 are inserted into the space between the both metal molds 2 and 4 from their circumferentially equally dividing positions so that there are movable in a horizontal direction. These cores 5 are fixed to a piston rod 7 of a cylinder 6 supported on the side of the movable platen 3 and advance or withdraw in a horizontal direction by hydraulically advancing or withdrawing the piston rod 7. By the both metal molds 2 and 4 and the closed cores 5, a cavity 8 is defined. An injection sleeve 9 is fitted into a sleeve hole formed through the fixed platen 1 and the fixed metal mold 2 from the lower direction so that it can be inserted thereinto or detached therefrom. A plunger chip 10 which advances or withdraws by an injection cylinder is fitted into the injection sleeve 9 so that it can advance or withdraw. A hot molten metal 11 is poured into the injection sleeve 9 under condition where the injetion sleeve 9 is detached from the sleeve hole.

In the above-mentioned arrangement, when the injection sleeve 9 is fitted into the sleeve hole with the hot molten metal 11 being poured into the injection sleeve 9, thereafter to advance the plunger chip 10, the hot molten metal 11 is injected into the cavity 8. Thus, after the hot molten metal is solidified and cooled, the movable platen 3 is caused to move upwardly thus to conduct the opening of the mold and the cores 5 are opened in an outward diretion, thus to extrude a product having been solidified within the cavity 8 using a product extruding devie (not shown) to take out the product toward the outside of the die casting machine.

In such a die casting work, unless casting of the hot molten metal is carried out for a relatively short time, temperature of the hot molten metal lowers to increase the viscosity. As a result, this causes poor circulation of the hot molten metal within the metal mold cavity, thus allowing the quality of the formed part to be lowered. For this reason, it is necessary to cast the hot molten metal as short as possible. Contrary to this, according as the injection speed is increased, the surface of the hot molten metal within the injection sleeve or the metal mold cavity becomes disturbed, whereby it is brought into the dispersed condition. Thus, the involvement of such an atmosphere leads to inclusion of blowholes in the forming process. This may cause occurence of nests in the formed part or other unfaborable phenomina, resulting in high possibility that problems will occur in respect of strength, pressure resistance and liquid-proofing property.

In view of this, it is the present state that forming of disk wheels is carried out in dependance upon a so called squeeze casting method in order not to disturb the flow of hot molten metal within the metal mold as far as possible and to avoid the involvement of gas to the utmost in the process of forming them using the vertical die casting machine, the squeeze casting method being characterized in that the advancing speed of the plunger chip for injection is set to a relatively low speed of approximately 20 to 100 mm/sec and in that casting is carried out at a fixed speed from the beginning of the injection to the time when the hot molten metal is completely filled up.

With the method of forming disk wheels based on such a squeeze casting method, for example, when the diameter of the disk wheel is about 13 to 14 inches and the means thickness at the time of forming is about 5 to 6 mm, high quality and high strength disk-shaped products can be produced. However, when an attempt is made to allow the thickness to be less than 4 mm with a view to thinning the thickness for realization of lightness, the above-mentioned conventional forming method has the problem that even if heat insulation of the metal mold and the like may be strengthen as far as possible, circulation of the hot molten metal is extremely degraded, resulting in very difficulty in forming.

SUMMARY OF THE INVENTION

With the above in view, an object of the present invention is to provide a method and an apparatus for forming disk wheel like formed parts which eliminate the possibility that gas is involved in hot molten metal thereby to satisfactorily discharge gas at any time, thus making it easy to provide high quality formed parts in which no next is present.

Another object of the present invention is to provide a method an apparatus for forming disk like wheel like formed parts which have improved gas discharge ability, thus to provide still more high quality formed parts.

A further object of the present invention is to provide a method and an apparatus for forming disk wheel like formed parts which can provide formed products such as aluminum wheel having vey thin thickness.

A still further object of the present invention is to provide a method and an apparatus for forming disk wheel like formed parts which can also provide die casting formed parts to which heat treatment or welding can be applied.

To achieve these objects, the present invention provides a method for forming a disk wheel like formed part by placing the mold axis of a metal mold cavity in a vertical direction which corresponds to the axis of rotation of a disk wheel, thus to inject hot molten metal from the bottom of the metal mold cavity in the mold axis direction, the control mode of the injection speed comprising a first phase to allow an injection speed when the hot molten metal has reached the inlet of the metal mold cavity to be low; a second phase to allow an injection speed from the time when the hot molten metal passes a disk wheel hub equivalent portion of the metal mold cavity until it passes the greater part of a disk wheel rim portion thereof via a disk wheel disk portion thereof to be, at the end portion of the rim equivalent portion, equal to a lower speed or less, which corresponds to a gas discharge ability of a degassing unit provided in association with the metal mold; and a third phase to close a discharge valve of the degassing unit after the hot molten metal has passed the greater part of the rim equivalent portion to continuously carry out injecting operation, thus allowing the hot molten metal to be completely filled up into the metal mold cavity.

In such a forming process, gas within the metal mold cavity may be naturally discharged to the air or vacuum-discharged through a discharge hole provided in the degassing unit. In this case, gas within the metal mold cavity may be discharged from the upper and lower end portions of the disk wheel rim equivalent portion.

Moreover, according as hot molten metal advances within the metal mold cavity at the above-mentioned second phase, the injection speed at the second phase may be increased to an injection speed which varies substantially in correspondence with changes in cross section of the respective equivalent portions.

In addition, a plurality of grooves substantially equidistantly arranged in a circumferential direct may be provided on the side of at least one of the disk wheel rim equivalent portion of the metal mold cavity and the disk wheel disk equivalent portion thereof.

DETAILED DESCRIPTION OF PREFERRED EMBODIMENTS

The present invention will be described in detail in connection with various preferred embodiments according to the present invention with reference to attached drawings.

Figure 1:
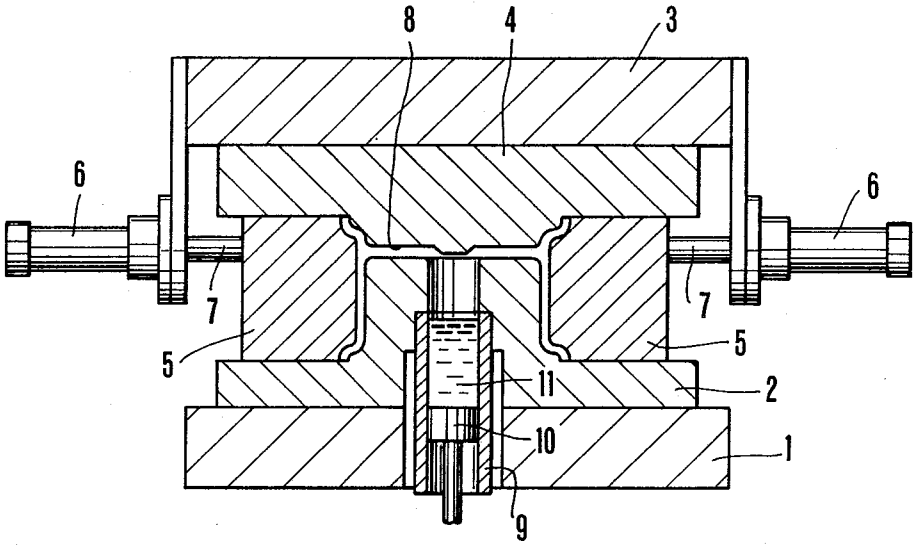
FIG. 1 (PRIOR ART)
FIG. 1 is a schematic longitudinal cross sectional view of a metal mold and an injection unit illustrated for the purpose of explaining a conventional method of forming disk wheels.
Figure 2:
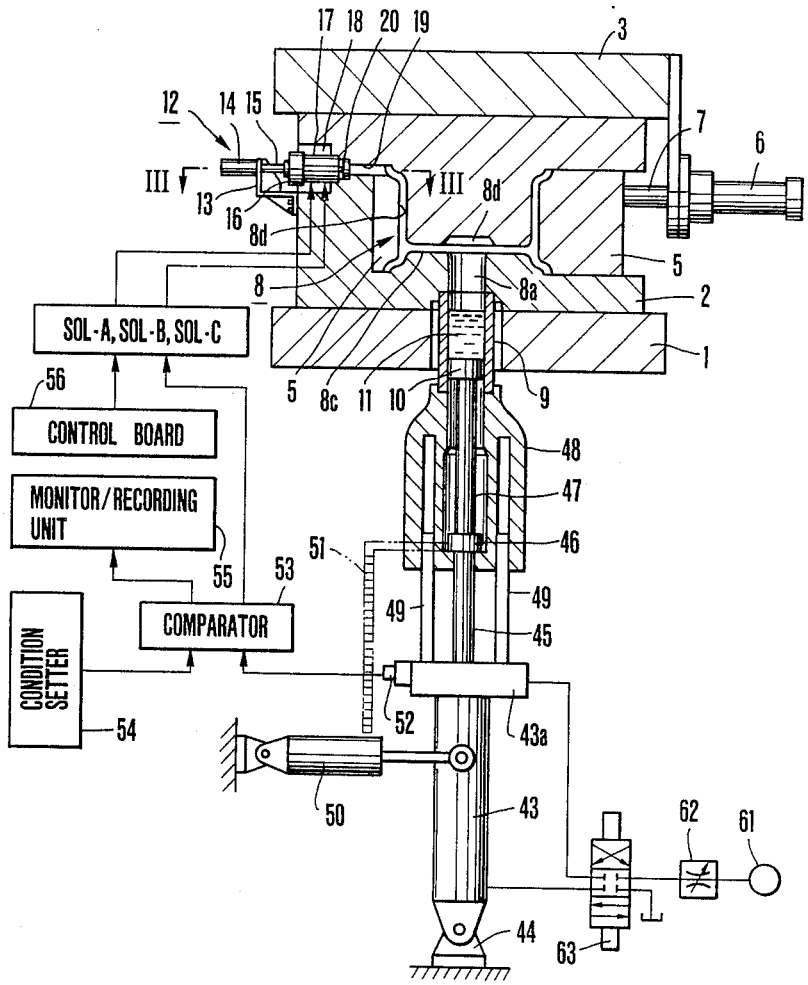
FIG. 2 is a longitudinal cross sectional view schematically an embodiment of an apparatus for carrying out a method according to the present invention.

Initially, a first preferred embodiment of the present invention will be described in conjunction with FIGS. 2 to 6. In these drawings, components identical to those in FIG. 1 are designated by the same reference numerals, respectively and their explanation will be omitted. FIG. 2 is a longitudinal cross sectional view illustrating an arrangement including a metal mold and an injection unit employed in this embodiment with the right and left halves thereof being shifted in their phases by an angle of 45 degrees in a circumferential direction. While the cavity 8 in the arrangement shown in FIG. 2 is disposed with it being vertically opposite to that in the arrangement shown in FIG. 1 and the fixed metal mold 2, the movable metal mold 4 and the cores in FIG. 2 are different from the respective corresponding members in their shape, the equipvalent portions are designated by the same reference numerals, respectively. By coupling the fixed metal mold 2 affixed to the fixed platen 1, the movable metal mold 4 affixed to the movable platen 3, and a plurality of cores 5 (four cores with their phases being shifted by a phase angle of 90 degrees in the circumferential direction in this embodiment) which advance or withdraw in a horizontal direction by the cylinder 6, the cavity 8 is formed. The cavity 8 is provided with a biscuit portion 8*a*, a hub portion 8*b*, a disk portion 8*c* and a rim portion 8*d* as the portions equivalent to the disk wheel as a formed part.

In association with the metal molds 2 and 4, there is provided a degassing unit of which entirety is designated by reference numeral 12 with the degassing unit being supported, for example, on the side of the fixed metal mold 2 and being out of phase of 45 degrees in the circumferential direction. Namely, for example, a cylinder 14 is affixed to the end edge of a bracket 13 fixed on the side of the fixed metal mold 2. A cylindrical spool 17 is fixed to an end flange portion 15*a* serving as end of action of a piston rod which advances or withdraws due to the hydraulic pressure of the cylinder 14 with the cylindrical spool 17 being fitted into a circular hole 18 formed in the mold alignment portion of the both metal molds 2 and 4 in a manner that it is inserted thereinto or detached therefrom. In carrying out the mold clamping and the mold opening, the spool 17 is adapted to be inserted and thrusted into the circular hole 18 through the piston rod 15 and a holder 16 by the actuation of the cylinder 14. In front of the end portion into which the spool 17 is inserted, a degassing groove 19 communication with the cavity 8 is formed with it being equally occupied within the both metal molds 2 and 4. A valve chamber 20 is formed at the opening end of the degassing groove 19 with it being equally occupied within the both metal molds 2 and 4. The degassing groove 19 and the valve chamber 20 are caused to communicate with each other by means of a bypass 21 laterally detouring. In addition, a valve seat 22 facing the valve chamber 20 is formed at the opening end of the spool 17.

Figure 3:
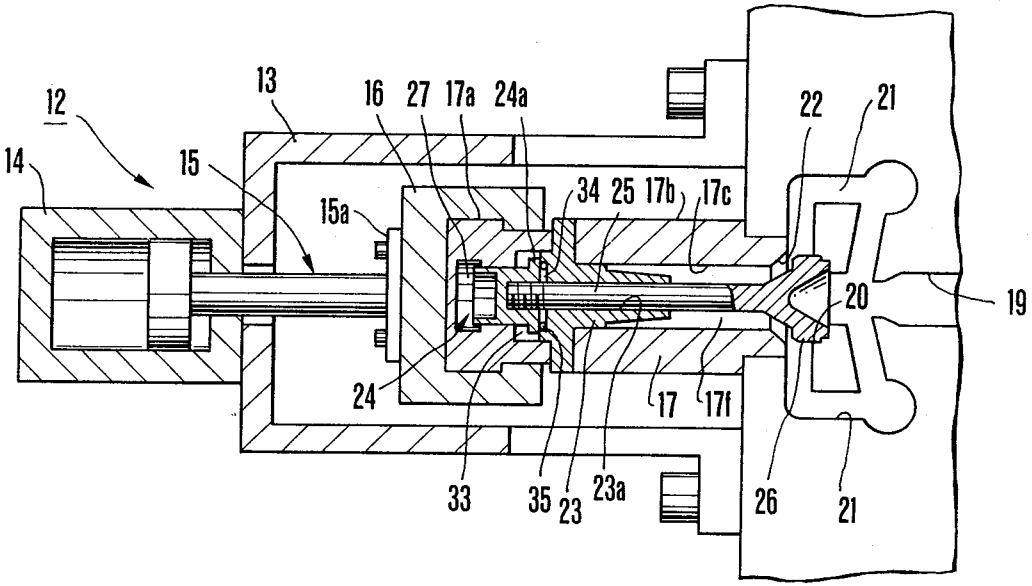
FIG. 3 is an enlarged longitudinal cross sectional view taken along the line III—III in FIG. 2.

The degassing unit will be now described with reference to FIGS. 3 and 4. The spool 17 is divided into members 17*a* and 17*b*. By these members 17*a* and 17*b*, a flange portion of a valve guide 23 fitted into an inner hole 17*c* is supported therebetween. In this condition, the members 17*a* and 17*b* and the valve guide 23 are integrally combined with each other. A piston 24 is positioned outside of the valve guide 23 and is slidably fitted into an inner hole 17*d* of the member 17. A screw portion of a valve rod 25 fitted into an inner hole 23*a* provided in the valve guide 23 so that it can advance or withdraw is screw-threadedly inserted into the central screw hole of the piston 24, whereby the valve rod 25 is incorporatedly combined with the piston 24. The valve rod 25 is integrally formed at its end portion with a valve body 26. The valve body 26 and the valve seat 22 are adapted to be placed in closed condition when the valve body 26 is moved backwardly from the opening condition shown in FIGS. 3 and 4. In the valve-closed condition as shown, the valve body 26 is engaged with step portions provided at the opening portion of the degassing groove 19 to close the degassing groove 19. A discharge hole 17*e* is provided for discharging, to the outside, gas which is guided to the valve chamber 17*f* of the spool 17 via the bypass 26 in the valve-closed condition.

To a chamber on the opposite side to the piston 24, i.e., a hed side chamber 27 within the member 17*a* of the spool 17 forming the cylinder along with the piston 24, ports 28*a* and 28*b* are opened. The port 28*b* is connected to an air source 32 through a piping 31 provided with a switch valve 29 having a solenoid SOL-A and a decompressed valve 30. On the other hand, a flange 24*a* is formed at the step portion on the side of the valve body of the piston 24. On the side opposite to the valve body of the flange 24*a* and on the side of the valve body thereof, a rod side main chamber 33 and a rod side auxiliary chamber 34 are formed, respectively. An O ring 35 is fitted over the rod side auxiliary chamber 34. A port 36 provided at the rod side main chamber 33 is connected to the air source 32 through a piping 39 provided with a switch valve 37 having a solenoid SOL-B and a decompressed chamber 38. In addition, a port 40 provided at the rod side auxiliary chamber 34 is connected to the air source 32 through a piping 43 provided with a solenoid SOL-C and the above-mentioned decompressed chamber 38.

In the apparatus thus configured, when the solenoid SOL-A is energized and the solenoids SOL-B and SOL-C are deenergized, fluid flows from the ports 28*b* and 28*a* into the head side chamber 27. As a result, when it pushed the piston 24, the valve seat 22 is opened. In this condition, when the solenoid SOL-B is energized and then the solenoid SOL-A is deenergized, one end surface of the piston 24 is pushed toward the O ring 35 as shown in FIGS. 3 and 4. At this time, the fluid within the head side chamber 27 exhibits an atmospheric pressure, and the fluid within the rod side auxiliary chamber 34 exhitits substantially atmospheric pressure because it is leaked through a gap between the valve rod 25 and the inner hold 23*a* of the valve guide 23.

Figure 4:
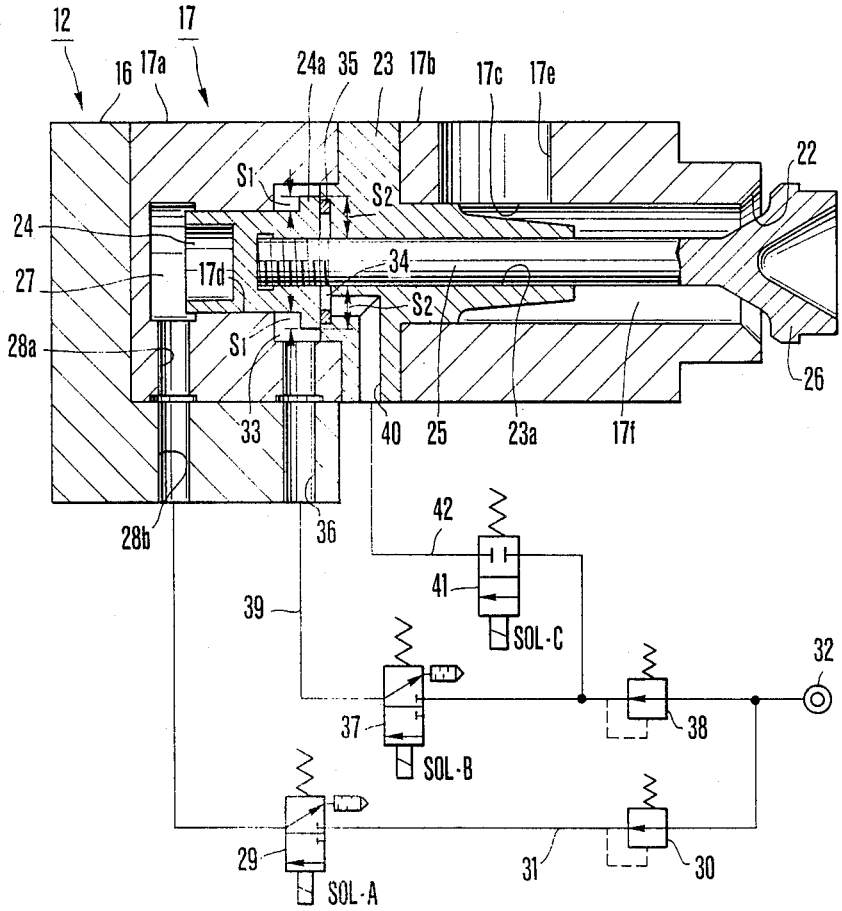
FIG. 4 is a partially enlarged view of FIG. 3, FIGS. 5($a_1$) to 5($d_1$) are longitudinal cross sectional views illustrating the metal mold and the injection unit at respective time points from the beginning of the injection to the completion of filling up of the hot molten metal, respectively, FIGS. 5(*a*) and 5(*d*) are lateral cross sectional views showing the essential parts of a degassing unit which correspond to FIGS. 5(*a*) and 5(*d*), respectively.

The apparatus according to this embodiment is constituted as shown in FIG. 4 so that the pressure receiving area $S_2$ on the side of the rod side auxiliary chamber 34 of the flange 24*a* is larger than the pressure receiving area $S_1$ on the side of the rod side main chamber 33. As a result, this apparatus operates as follows. In the above-mentioned valve opening condition, the piston 24 is pushed to the O ring 35 by the force expressed by $S_1 \times$hydraulic pressure. In this condition, when the solenoid SOL-C is energized to switch valve 41 thus to exert hydraulic pressure on the rod side auxiliary chamber 34, or the valve body 26 is slightly thrusted up in the closing direction by an external force due to inertia force of hot molten metal and the like, so that it is away from the O ring 35, fluid enters into the rod side auxiliary chamber 34 as well through the gap. As a result, since a force expressed by $S_2 \times$hydraulic pressure is applied to the lower side of the piston 24, the piston 24 is caused to rapidly move upwardly because the relationship of $S_2 > S_1$ holds. Accordingly, the valve seat 22 is quickly closed, whereby the valve-closed condition is maintained.

Figure 6:
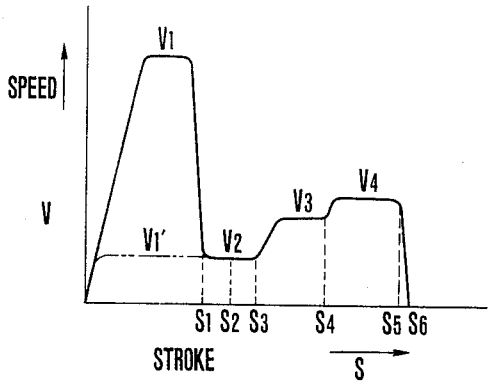
FIG. 6 is a characteristic curve showing the relationship between the stroke and the speed of the plunger chip employed in the present invention.

A control device for the solenoids SOL-A, SOL-B and SOL-C will be now described. As best shown in FIG. 2 illustrating the control unit using a device for detecting position of the plunger chip 10, the metal mold, and the degassing unit for the metal mold, there are provided an injection cylinder 43 attached to a fixed bracket 44 so that it can fluctuate, a piston rod 45 of the injection cylinder 43, a coupling 46, and a plunger 47 provided at its end edge with the flunger chip 10. On the other hand, the injection sleeve 9 is fixed on the upper end portion of a cylinder block 48. The cylinder block 48 is slidably affixed to a ram rod 49 attached to an upper flange portion 43*a* of the injection cylinder 43 through a cylinder portion 50 within the cylinder block 48. A cylinder 51 is provided for causing the injection cylinder 43 to fluctuate. After the injection sleeve 9 and the plunger chip 10 are caused to be lowered below the fixed board 1, this cylinder 51 activates the cylinder 50 for fluctuation to laterally allow the injection sleeve 9 along with the injection cylinder 43 to fluctuate, thus to pour hot molten metal into the injection sleeve 9, thus allowing the injection cylinder 43 etc. to be placed in a vertical condition. In this condition, the working oil is delivered to the cylinder portion 50 to elevate the cylinder block to move upwardly the injection sleeve 9 and the plunger chip 10, thus to couple the injection sleeve 9 to the fixed metal mold 2. There are further provided a hydraulic pump 61, a flow rate adjustment valve 62 of which valve opening and valve opening speed can be freely controlled by a pulse signal, and an electromagnetic switch valve 63 of which injection speed V can be freely controlled by the injection stroke S, for example, as shown in FIG. 6.

To the coupling 46 which has coupled the piston rod 45 to the plunger 47, a magnetic scale 51 extending in the axial direction of the injection cylinder 43 is fixed. A magnetic sensor 52 is disposed in the vicinity of the magnetic scale 51 with it being fixed to a portion of the injection cylinder 43. When the magnetic scale 51 moves along with the plunger 47, a pulse signal is extracted from the magnetic sensor 52. The pulse signal thus extracted is delivered to a comparator 53 and is input thereto. On the other hand, a condition setter 54 is provided for setting that the above-mentioned switch valves 29, 37 and 41 should be opened at which position of the stroke of the plunger 47 on the basis of the actuation of a timer (not shown). A signal from the condition setter 54 is input to the comparator 53. The comparator 53 is electrically connected to the solenoids SOL-A, SOL-B and SOL-C of the respective switch valves 29, 37 and 41. The both inputs are compared with each other. As a result of the comparison, when they are coincident with each other, or when the timer has counted a predetermined time, a signal is produced from the comparator 53. By responding to the signal thus produced, the respective solenoids are energized or deenergized at a predetermined timing. Especially, by responding to a valve closing command from the magnetic sensor 52, the solenoid SOL-C is energized, whereby the valve body 26 is closed. There are further provided a monitor/recording unit 55 and a control board for manually opening or closing the switch valves 29, 37 and 41.

For means to produce a valve opening command in the process of the injection, not only the magnetic sensor but also other electric command generator such as limit switches ordinarily widely used may be used.

Figure 5A:
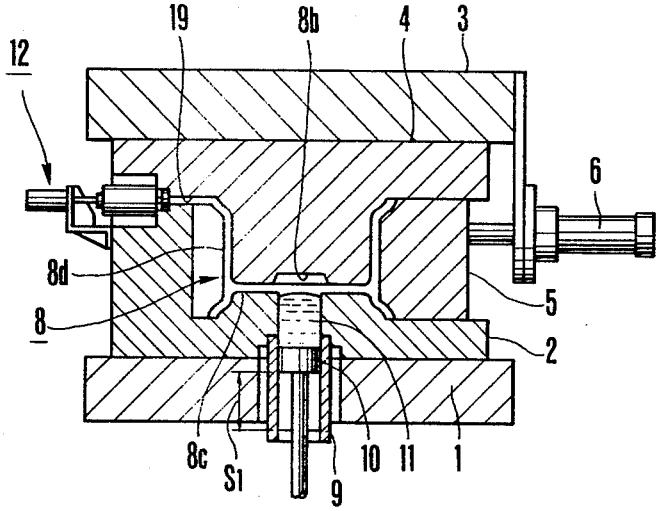
Figure 5:
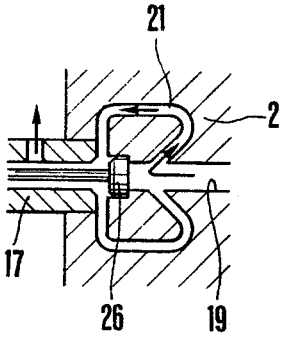
Figure 5B:
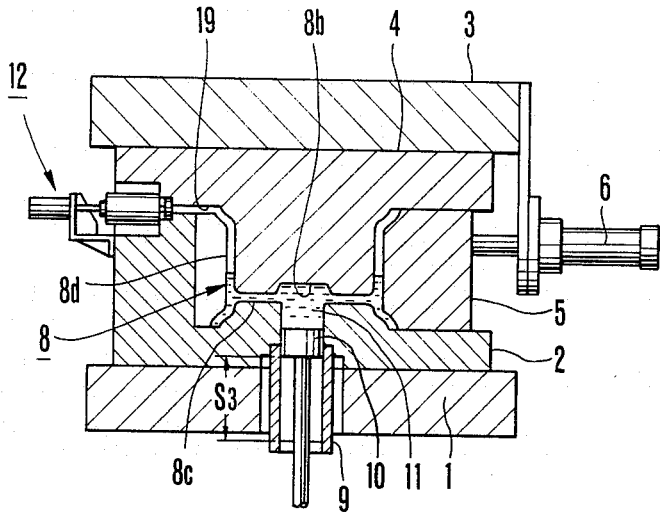
Figure 5C:
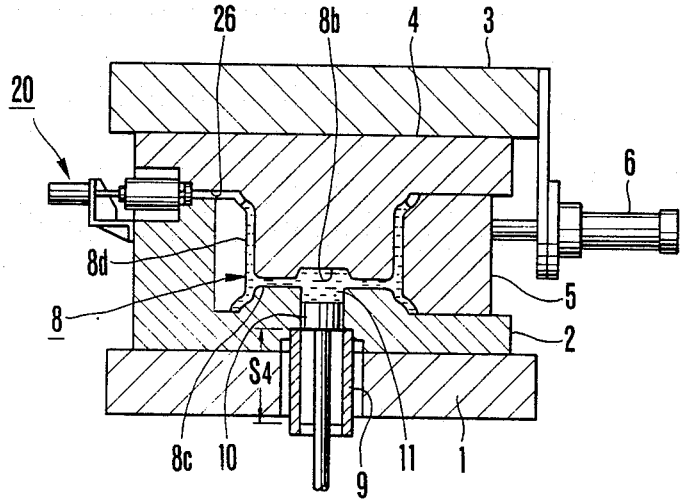

A method of forming disk wheels using the injection device thus configured will be described. First, the injection sleeve 9 into which the hot molten metal 11 has been delivered is fitted into the sleeve hole of the fixed metal mold 2 as shown in FIGS. 2 and 5(*a*). The spool 17 of the degassing unit 12 is fitted into the circular hole 18, thus placing the valve body 26 in opening conding as shown in FIGS. 3 and 4. Then, the plunger chip 10 is advanced to initiate the injection of the hot molten metal 11. FIG. 5(*a*) shows the condition that the hot molten metal 11 has reached the inlet of the cavity 8. The stroke of the plunger chip 10 from the biginning of the injection to that condition is represented with symbol $S_1$ in FIG. 5(*a*).

FIG. 6 is a characteristic curve showing the relationship between the stroke S and the speed V of the plunger chip 10 wherein abscissa and ordinate represent the stroke S and the speed V, respectively. The speed $V_1$ during the stroke $S_1$ is caused to be relatively high within a range where the surface of the hot molten metal is not disturbed, thus ensuring heat insulation of the hot molten metal 11. During this time period, as shown in FIGS. 3 and 4 and FIG. 5(*a*), gas within the cavity 8 enters from a space between to valve body 26 and the valve seat 22 into the spool 17 via the degassing groove 19, the bypass 21 and the valve chamber 20 and then is naturally discharged from the discharge hole 17*e* to the air.

Subsequently, when the plunger chip 10 is advanced to the position of the stroke $S_2$, the hot molten metal 11 moves from the hub portion 8*b* toward the disk portion 8*c*. The speed $V_2$ of the plunger chip 10 during this stroke is decelerated to be relatively low so as not to involve gas in the cavity 8. Gas is continuously discharged.

Then, when the plunger chip 10 is advanced to the position indicated by the stroke $S_3$ as shown in FIG. 5(*b*), the hot molten metal 11 has reached to rim portion 8*d*. At this time, a lower speed $V_3$ when the hot molten metal 11 has passed the rim portion 8*d* or for a time period during which it passes the greater part thereof is caused to be slightly higher than the speed $V_2$ in order to compensate degradation of the flow characteristic of the hot molten metal due to the fact that the hot molten metal is in contact with the metal molds 2 and 4 and heat is radiated, so that viscosity is increased. Thus, filling up of the hot molten metal is carried out at the slightly accelelated speed. In this instance, since the hot molten metal has already passed the junction of the disk portion 8*c* complicated in shape and the rim portion 8*d*, even if the filling speed $V_3$ is caused to be high at the rim portion 8*d*, it is sufficient to discharge gas only at the rim portion 8*d* simple in shape. Thus, the involvement of gas into the hot molten metal 11 can be avoided.

Then, when the plunger chip 10 is advanced to the position indicated by the stroke $S_4$ as shown in FIG. 5(*c*), the hot molten metal 11 has substantially passed the greater part of the rim portion 8*d* or the rim portion 8*d* itself. At this time, as long as fluidity of the hot molten metal 11 can be ensured, it is desirable to fill up the hot molten metal 11 just at the speed $V_3$. Particularly, when the disk wheel is thinned, fluidity is extremely lowered. For this reason, hot molten metal may be filled up at a speed $V_4$ slightly larger than the speed $V_3$.

At this time, at time slightly later than this time, i.e., when the hot molten metal 11 reaches the valve body 26 portion, or at time when the hot molten metal 11 has reached the portion slightly before the position of the stroke $S_4$, the solenoid SOL-C is energized by an electric signal to switch the switch valve 41 to move the piston 24 and the valve body 26 thus to close the valve. Thus, the hot molten metal which has continuously advanced is interrupted by the closed valve body 26, whereby it is prevented from being scattered to the outside. FIGS. 5(*d*) and 5($d_1$) shows the condition that after the valve body 26 had been closed, the hot molten metal 11 has reached the valve chamber 20 and discharge of the hot molten metal 11 within the degassing groove 19 and the bypass 21 is interrupted. After the hot molten metal 11 has passed the rim portion 8*d*, even if the injection speed is caused to be high, little involvement of gas in forming the end portion of the rim portion 8*d* is observed because the volume of the remaining gas is considerably small and the discharge ability of the degassing unit 12 is several or several ten times larger than that required for discharging the remaining gas.

Figure 7:
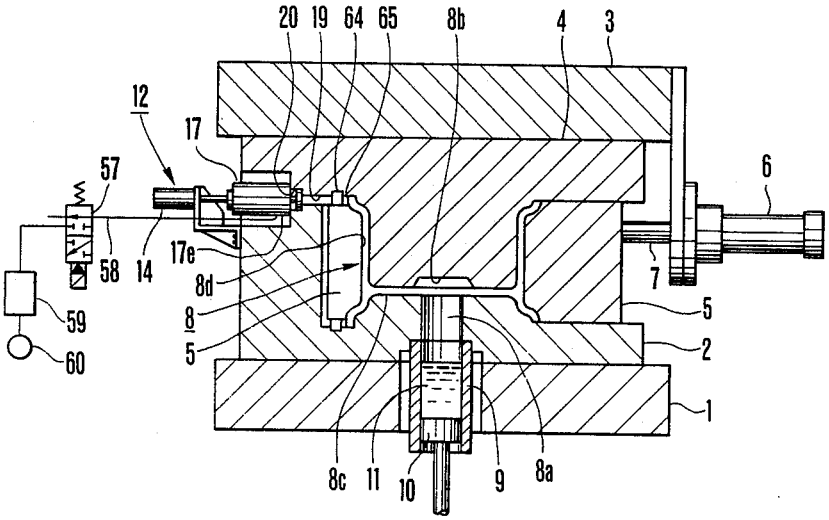
FIG. 7 is a schematic longitudinal cross sectional view illustrating another embodiment of an arrangement for carrying out a method according to the present invention wherein the arrangement comprises a metal mold and an injection unit in which a vacuum unit and upper and lower degassing grooves are provided in association with a degassing unit, FIG. 8(*a*) is an enlarged cross sectional view of a degassing unit employed in a further embodiment of an apparatus for carrying out a method according to the present invention, FIG. 8(*b*) is a cross sectional view taken along the line A—A of FIG. 8(*a*), FIGS. 9($a_1$) to 9($f_1$) are longitudinal cross sectional views illustrating the metal mold and the injection unit at respective time points from the beginning of the injection to the completion of filling up of the hot molten metal, respectively, FIGS. 9(*a*) to 9(*f*) are lateral cross sectional views showing the essential part of a degassing unit which correspond to FIGS. 9(*a*) to 9(*f*), respectively.

The case of opening the discharge hole 17*e* of the degassing unit 12 to the air has been described. In addition, coupling a vacuum unit to the discharge hole 17*e* is more effective. Namely, as shown in FIG. 7, a piping 58 provided with a switch valve 57 is connected to the discharge hole 17*e* to connect the piping 58 to the vacuum tank 59 to further connect the vacuum tank 59 to a vacuum pump 60. A discharge hole opened to the air, which is closed when the switch valve 57 is opened and is opened when closed, is provided in the switch valve 57 or the piping 58. Thus, when the switch valve 57 is opened at timing slightly before acceleration from the speed $V_3$ to $V_4$, allowing the discharge hole 17*e* and the vacuum tank 59 to communicate with each other, the interior of the cavity 8 is decompressed. Accordingly, even if filling up of a portion having a thin thickness and a large surface area is carried out at the speed $V_4$, this implementation is effective in that heat radiation of the hot molten metal 11 is small, and in that there is no possibility of lowering fluidity. In addition, since the interior of the cavity 8 is decompressed, there is a little possibility of involvement of gas into the hot molten metal 11 and involvement of gas at the rim portion 8*d* is hardly observed. It is sufficient that the time lag between the time for opening the switch valve 41 for decompression and the time for producing a command to change to the speed $V_4$ is approximately 0.3 to 0.5 seconds. During this time lag, the decompression within the cavity 8 is completed. Depending upon circumstances, vacuum evacuation may be initiated simultaneously with the switching to the speed $V_4$ or vacuum evacuation may be carried out at a timing earlier than that of the switching.

In this embodiment, immediately after the hot molten metal has reached the metal mold cavity 8, the injection speed is caused to be low, thus to continue the injection while passing an air within the cavity 8 through the degassing unit 12 to naturally discharge the air. Such an implemention is based on the following reasons. When the temperature of hot molten metal is relatively high, flowing of the hot molten metal is good. Accordingly, injection is carried out at a low speed so that gas is not involved into the hot molten metal within a range where there is no inconvenience in the flow of the hot molten metal. Moreover, if air within the cavity 8 is vacuum-evacuated through the degassing unit 12 from the first, there is high possibility that an exterior air is sucked from a portion between the outer peripheral surface of the plunger chip 10 and the inner peripheral surface of the injection sleeve 9, the joint surface of the both metal molds or the like. Thus, an exterior air is involved into the hot molten metal, resulting in high possibility that nests may be produced within the injection formed part. Elimination of such an air is quite difficult even if it is vacuum-evacuated. Further, as a matter of cource, an amount of air to be vacuum-evacuated becomes large, resulting in low efficiency and bad economy. However, since the temperature of the hot molten metal is lowered and flowing thereof somewhat becomes poor at the latter half of the injection, there is employed an implementation such that casting is carried out at a high speed while evacuating air within the cavity 8. Namely, at the time of the low speed injection, according as the hot molten metal advances within the cavity 8, the low injection is increased stepwise so that the injection speed is gradually increased. Then, when the portion of the cavity 8 corresponding to the body of the formed part is almost filled with the hot molten metal, or immediately before that time, i.e., when the greater part of the portion of the cavity 8 is filled thereof, even if the injection is increased to some extent, there is no possibility that air is involved into the hot molten metal forming the body of the formed part. Accordingly, the vacuum evacuation is initiated at this time and the speed for moving the hot molten metal is caused to be somewhat increased. For instance, in the case of die casting of the aluminum wheel, by carrying out at a low speed the total process from the time when the hot molten metal enters into the metal mold cavity 8 to the completion of the injection, circulation of the hot molten metal is good and degassing is sufficiently conducted, thus providing a high quality formed part to which heat treatment or welding may be applied. In addition, formed parts of aluminum which are extremely thinner than that of the conventional one can be produced.

For instance, in the case that the diameter of the disk wheel is 13 inches and the mean thickness of the rim portion 8*d* is approximately 3.5 mm, appropriate values of the above-mentioned speeds $V_1$ to $V_4$ are as follows.

$V_1$=about 250 mm/sec,
$V_2$=50 to 120 mm/sec,
$V_3$=100 to 150 mm/sec, and
$V_4$=100 to 170 mm/sec.

In the above-mentioned embodiment, it has been described that when hot molten metal is thrusted up to the entrance of the cavity 8, this is conducted at a high speed so that its temperature is not lowered as far as possible. In addition, the following method may be employed. By causing the temperature of the hot molten metal to be employed. By causing the temperature of the hot molten metal to be considerably high in advance, or causing the temperature at the time of heating from the external surface of the injection sleeve 9 to be slightly high, the hot molten metal maintains at a sufficiently high temperature when it has been thrusted up to the entrance of the cavity 8. Accordingly, the hot molten metal may be thrusted up at a relatively low speed $V_1'$ from the first.

It is needless to say that respective speeds $V_1'$, $V_2$, $V_3$ and $V_4$ shown in FIG. 6 may be set to the same value.

In the arrangement shown in FIG. 7, the degassing groove 19 is provided not only from the upper portion of the disk wheel rim equivalent portion 8*d* of the metal mold cavity 8 but also from the lower portion thereof, and the upper and lower degassing grooves 19 are caused to communicate with each other to allow then to communicate with the valve chamber 20 of the degassing unit 12. The arrangement shown in FIG. 7 includes an annular groove provided spaced from the outer peripheries of the upper and lower end portions of the rim equivalent portion 8*d*, and a relatively narrow passage connecting the upper and lower portions of the rim equivalent portion 8*d* to the annular groove 64 at several portions in a radial direction. When gas is thus evacuated from the upper and lower end portions of the rim equivalent portion 8*d*, gas evacuation becomes still more desirable.

As understood from the foregoing description, this embodiment provides a method for forming disk wheel like formed parts to place mold axis of a metal mold cavity corresponding to the rotation axis of a disk wheel in a vertical condition to inject hot molten metal from the bottom in the direction of the mold shaft, the method being characterized in that a degassing unit is provided in association with the metal mold unit, thus allowing an injection speed when the hot molten metal has reached to the entrance of the metal mold cavity to be low, in that an injection speed when the hot molten metal has completely passed a rim equivalent portion from a disk wheel hub equivalent portion of the metal mold cavity via the disk equivalent portion is caused to be equal to a low injection speed less than that of the gas discharge ability of the degassing unit provided in association with the metal mold assembly, and in that after the hot molten metal has passed the greater part of the rim equivalent portion, a valve closing signal is delivered to the degassing unit to continue the injection with the valve of the degassing unit being closed, thus allowing the hot molten metal to be completely filled into the metal mold cavity. Thus, this eliminate the possibility of involving gas into the hot molten metal to desirably discharge gas at any time, thus making it possible to easily produce nest-free, high quality formed parts.

In the injection of the hub portion and the rim portion, while effecting natural evacuation using the degassing unit, injection is carried out at a low speed corresponding to the cavity cross section and capable of ensuring the suitable flowing characteristic of the hot molten metal, thus to realize less involvement of gas into the hot molten metal and good circulation of the hot molten metal, resulting in improved quality of the formed part.

At the early stage of the injection, gas eithin the cavity is naturally discharged through the metal mold degassing unit, and at the final stage of the injection, remaining gas within the cavity is forcedly and promptly discharged due to the vacuum evacuation, thus making it possible to easily ensure the discharge of gas with high efficiency, resulting in realization of still more higher quality formed parts.

In addition, a method to discharge gas from the upper and lower both sides of the rim equivalent portion is used in combination, thus making it possible to produce still more high quality formed parts having good gas discharge ability.

Thus, the forming method according to this embodiment can assuredly and easily provide extremely thin aluminum wheels having thickness of 3 or 4 mm or smaller than that which could not be produced in the prior art. In addition, this method can also provide die casting formed parts of aluminum to which heat treatment or welding can be applied.

A preferred second embodiment will be described with reference to FIGS. 8 and 9 wherein parts identical to those in the preceding drawings are designated by the same reference numerals, respectively, and therefore their explanation will be omitted.

Figure 8A:
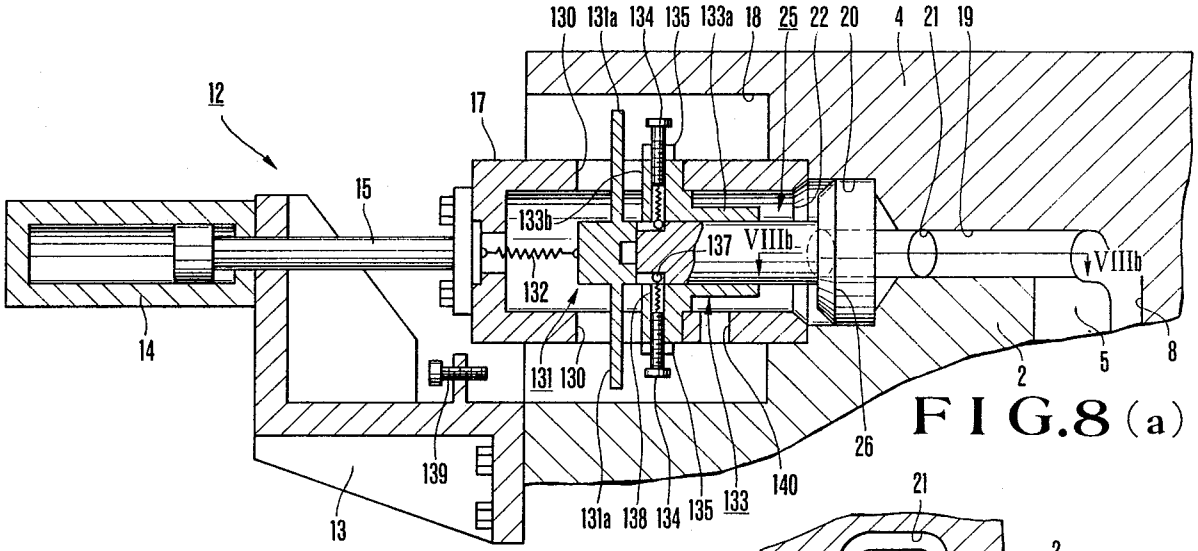
Figure 8B:
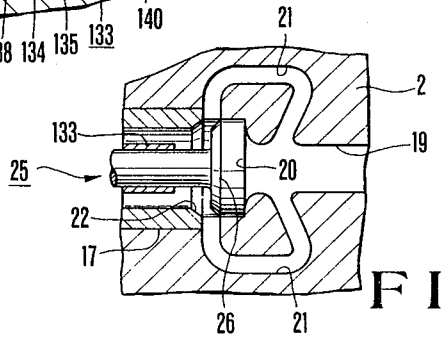
Figure 9A:
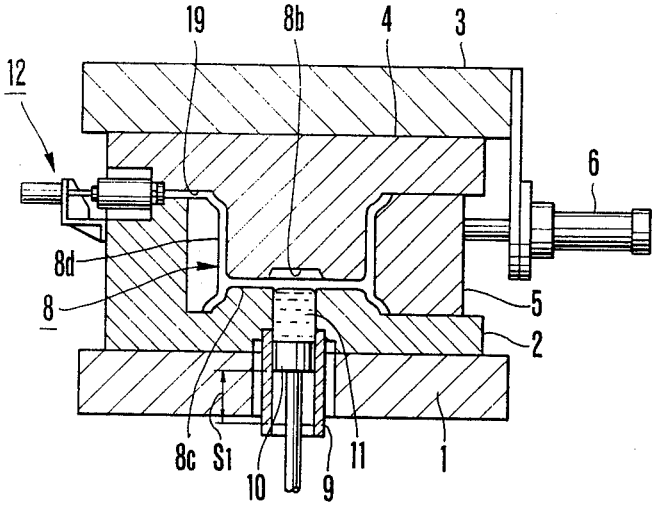
Figure 9:
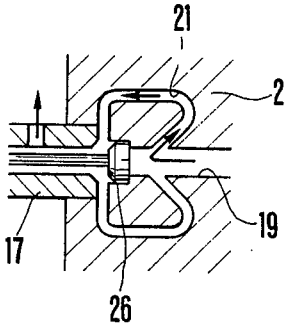
Figure 9C:
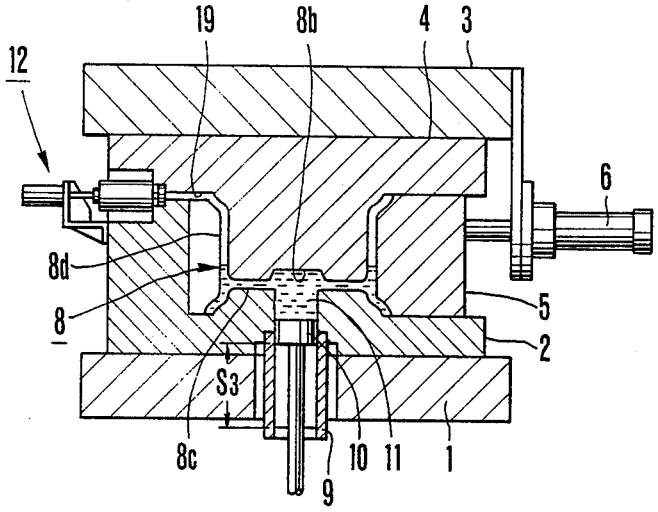
Figure 9:
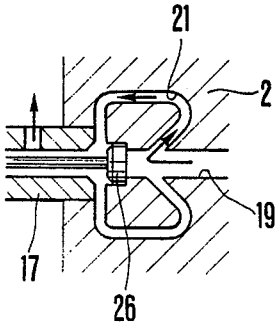
Figure 9D:
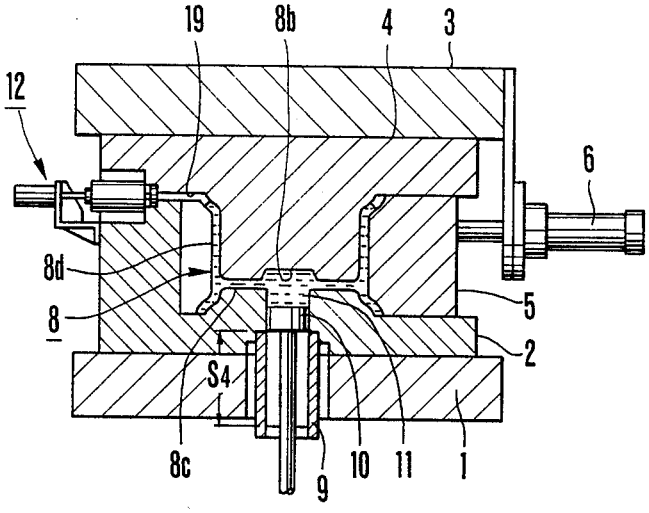
Figure 9:
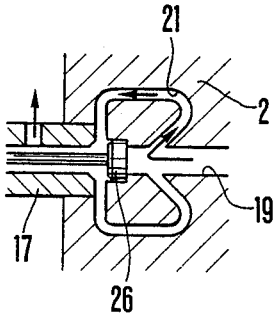

As best shown in FIG. 8, both lever portions 131*a* of a return lever 131 is slidably fitted into a pair of elongated holes provided in the outer peripheral wall of the spool 17. Between the return lever 131 and the piston rod 15, there is provided a tensile spring 132 for outwardly biasing the return lever 131 or a tensile member such as a solenoid unit or a gravity unit. A valve guide 133 is integrally formed by a cylindrical portion 133*a* and a pair of screw portions 133*b*. The valve guide 133 is slidably supported by the spool 17 with the screw portions 133*b* being fitted into the elongated hole 130. The valve rod 25 is axially supported by the cylindrical portion 133*a* so that it can slide with the screw portion at one end thereof being screw-threadedly inserted into the screw hole of the return lever 131. At one end of the valve rod 25, there is provided the valve body 26 which sits on the valve seat 22 by the elevation. The valve body 26 which has been opened sits on the valve seat 22 by an inertia force of the hot molten metal advancing from the cavity 8 to interrupt the communication between inner chamber of the spool 17 and the degassing groove 19 and the bypass 21. The arrangement shown in FIG. 8 includes balls 137 which are engaged with the longitudinal groove of the valve rod 25 due to the biasing force by a compression coil spring 138, bolts 134 which hold one end of the compression coil spring 138 within the screw portion 133*b* and can suitably adjust the strength of the compression coil spring 138, and nuts 135 for fixing these bolts 134 to the screw portions 133*b*. These members 137, 134 and 135 constitute an engagement mechanism. When pressure of the hot molten metal is exerted on the valve body 26, the valve rod 25 allows the balls 137 to be withdrawn to close the valve. This permits the valve body 26 which has been closed once not to be opened again due to the action by the tensile spring 132 etc. unless an external force is applied. The valve body 26 is opened by pushing the lever portion 131*a* inwardly. This arrangement further includes a stopper 139 which limits the backward movement of the spool 17 withdrawing by the actuation of the cylinder 14 to a predetermined piston and is fixed to the bracket 13 so that the lever portion 131*a* of the return lever 131 is in contact therewith, and a discharge hole 140 allowing the interior of the spool 17 and the air to communicate with each other.

The outline of the method of forming disk wheels according to this embodiment is the same as that of the first-mentioned embodiment and therefore the detailed explanation will be omitted. FIGS. 9(*a*) to 9(*f*) are longitudinal cross sectional views illustrating the metal mold and the injection unit at respective points from the beginning of the injection to the completion of filing up of the hot molten metal, respectively. FIGS. 9($a_1$) to 9($f_1$) are lateral cross sectional views illustrating the essential part of the degassing unit which correspond to FIGS. 9(*a*) to 9(*f*), respectively. The process shown in FIG. 9(*a*) is similar to the process shown in FIG. 5(*a*), but differs from the latter in that the plunger chip 10 is not advanced to the position indicated by the stroke $S_2$ at this process. This is accomplished at the process shown in FIG. 9(*b*). The process shown in FIG. 9(*c*) corresponds to the process shown in FIG. 5(*b*). Likewise, the process shown in FIG. 9(*d*) corresponds to the process shown in FIG. 9(*d*) corresponds to the process shown in FIG. 5(*c*). In this instance, the injection speed $V_4$ is equal to a speed for exerting inertia force sufficient to close the valve body 26 of the degassing unit 12. Under condition of this speed $V_4$, the stroke $S_4$ is changed to the stroke $S_5$ as shown in FIG. 9(*e*). Thus, the hot molten metal 11 enters into the degassing groove 19. Further, when the hot molten metal 11 enters into the valve chamber 20 as shown in FIG. 9(*f*), the valve body 26 is closed due to the inertia force of the hot molten metal 11. Thus, the hot molten metal 11 is prevented from being scattered. FIG. 9($e_1$) shows the condition that the hot molten metal has reached the valve chamber 20, and FIG. 9($f_1$) shows the condition that the hot molten metal 11 causes the valve body 26 to be closed, whereby discharging the hot molten metal 11 within the degassing groove 19 and the bypass 21 is shut off.

It is to be noted that the above-mentioned vacuum unit may be connected to the degassing unit in this embodiment. The die casting of aluminum wheels based on the forming method according to this embodiment will be now described. An injection is carried out at a low speed over, for example, 80 to 90% of the process from the time when the hot molten metal begins entering into the metal mold cavity 8 to the completion of injection and at a high speed over the remaining 10 to 20% thereof. Such an implementation ensures that circulation of the hot molten metal is good and degassing is sufficiently conducted, thus providing a high quality formed part to which heat treatment or welding may be applied. In addition, a formed parts of aluminum which are extremely thinner than that of the conventional one can be produced.

A third preferred embodiment will be now described.

The outline of the arrangement according to this embodiment is similar to that of the first-mentioned embodiment, but differs from the latter in that there are provided discharge passages at upper and lower end portions of the disk wheel rim equivalent part of the metal mold cavity to connect these discharge passages to the degassing unit provided in association with the apparatus body.

Figure 10:
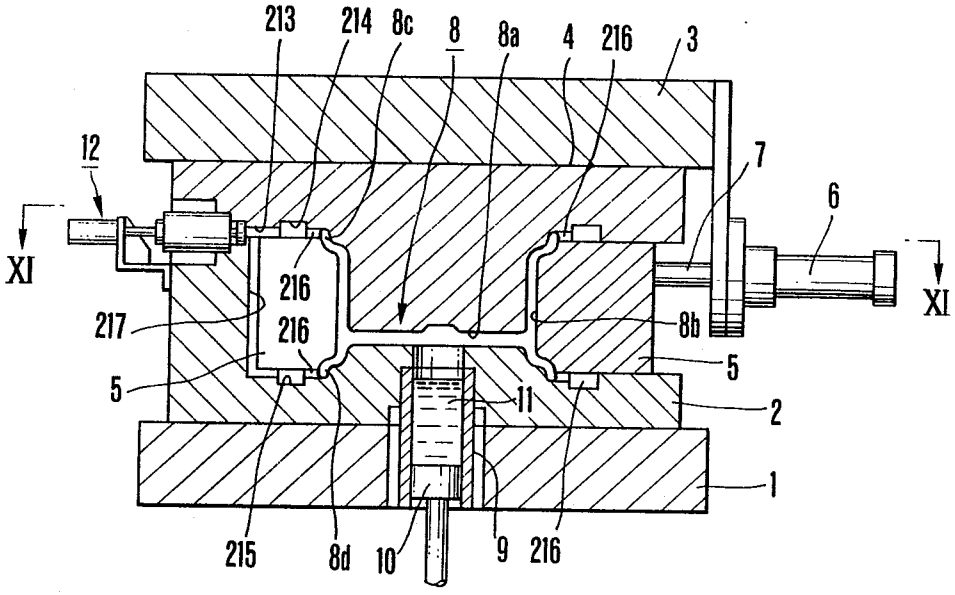
FIG. 10 is a partially developed longitudinal cross sectional view illustrating a still further embodiment of a metal mold employed in the present invention.
Figure 11:
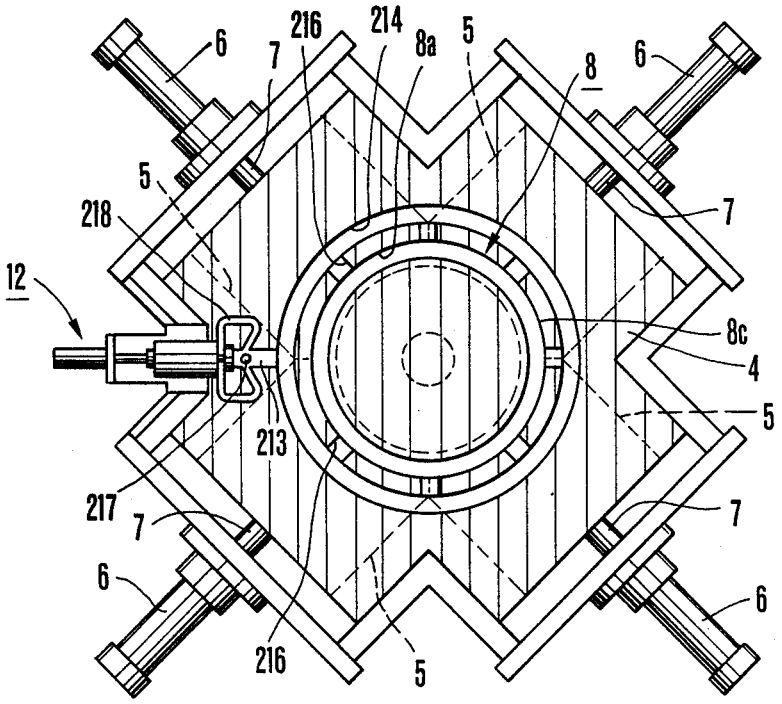
FIG. 11 is a lateral cross sectional view taken along the line A—A in FIG. 10.

As best shown in FIGS. 10 and 11, annular grooves 214 and 215 coaxial with the outer and lower peripheries at the rim portions of the cavity 8 are respectively provided on the side of the movable metal mold 4 outwardly of the both peripheries. These annular grooves 214 and 215 and the outer peripheries at the upper and lower ends of the rim portion are connected by a plurality of discharge passages 216 provided at positions circumferentially equally divided. The degassing groove 19 connected to the valve chamber of the degassing unit 12 is opened to the upper annular groove 214. Further, a degassing groove 213 and the lower annular groove 214 are caused to communicate with each other by a communicating hole provided in the fixed metal mold 2. A discharge valve (not shown) of the degassing unit 12 is provided in the degassing groove 213 portion which is caused to communicate with the annular groove 214. For the purpose of ensuring smooth injection, an arrangement is employed in this embodiment such that each passage 216 is out of position with respect to the degassing groove 213. In the fixed metal mold 2, the penetration portion of a communicating hole 217 is separately formed for convenience of machining. In addition, a detouring bypass 218 is provided in a manner that the degassing groove 213 and the valve chamber are caused to communicate with each other.

The operation for forming disk wheel using the arrangement including the metal mold and the injection unit thus configured will be now described. After the injection sleeve 9 into which the hot molten metal 11 has been delivered is inserted into the sleeve hole to open the discharge valve of the degassing unit 12, when the plunger chip 10 is advanced, the hot molten metal 11 is thrushed up within the injection sleeve 9 to reach the disk portion 8*a*. Then, the hot molten has flowed through the disk portion 8*a* in a radial direction thereafter to reach the rim portion 8*b*, thus beginning to be filled into the rim portion 8*b*. At this time, since the interiors of the disk portion 8*a* and the rim portion 8*b* are caused to communicate with the atmosphere through the discharge valve of the degassing unit 12, a part of gas within the disk portion 8*a* and the rim portion 8*b* is discharged from the cavity 8 toward the atmosphere via the upper discharge passage 216, the annular groove 214, the degassing groove 213, the bypass 218, and the opened discharge valve. On the other hand, gas at the lower portion is discharged from the cavity 8 toward the atmosphere via the lower discharge passage 216, the annular groove 215, the communicating hole 217, the degassing groove 213, the bypass 218, and the opened exhaust valve. In this instance, since gas is discharged from the upper and lower end portions of the rim portion 8*b* at the same time, even if the hot molten metal 11 successively stays from the lower end portion, there is no possibility that gas is locked in by the hot molten metal 11. In this embodiment, since gas is spreaded into the annular grooves because of the provision of the annular grooves 214 and 215, there is no possibility that evacuation is not hindered even if the discharge passage 216 is partially clogged with the hot molten metal. Thus, when the hot molten metal is filled up to reach the discharge valve of the degassing unit 12, the discharge valve is closed by the inertia force of the hot molten metal 11, so that flowing out of the hot molten metal s interrupted. The hot molten metal 11 is thus filled up. Then, after the hot molten metal 11 is solidified and cooled, opening the metal mold is carried out to open the cores 5, thus to take out the formal part.

In such an injecting operation, unless the hot molten metal 11 from the side of the degass groove 213 and the hot molten metal 11 from the side of the communicating hole 217 reach the degassing unit 12 at the same time, discharging of gas on the side where the hot molten metal 11 lately arrives at the degassing unit 12 is not sufficiently carried out. Accordingly, it is desirable that the diameter of the communicating hole 217 of long distance is larger than the diameter of the degassing groove of short distance.

Figure 12:
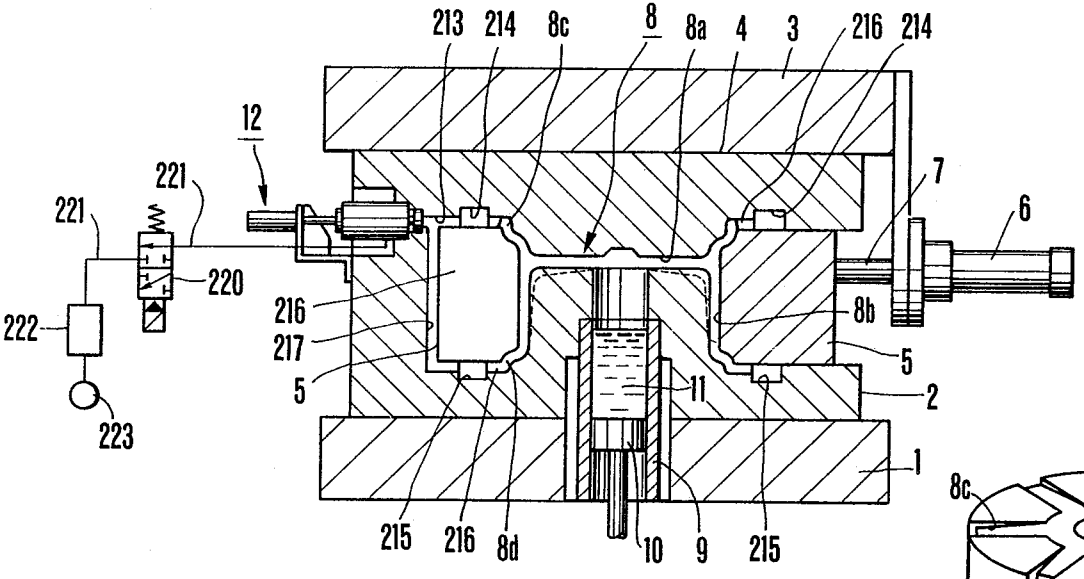
FIG. 12 is a partially developed longitudinal cross sectional view illustrating a metal mold and an injection unit employed as the modified embodiment of FIG. 10 in the present invention.

FIG. 12 is a partially developed longitudinal cross sectional view schematically a modification of the arrangement shown in FIGS. 10 and 11. This embodiment is characterized in that a vacuum unit is provided in association with the degassing unit 12 wherein the remaining parts identical to those shown in FIG. 10 are designated by the same reference numerals and therefore their explanation will be omitted. Namely, to the discharge hole of the discharge valve provided in the degassing unit 12, which has been opened to the atmosphere in the above-mentioned embodiment shown in FIGS. 10 and 11, a piping 221 provided with a switch valve 220 is connected. A vacuum tank 222 is connected to the piping 221. Further, a vacuum pump 223 is connected to the vacuum tank 222. In addition, the piping 221 is provided with a discharge hole opened to the atmosphere which is closed when the switch valve 20 is opened and is opened when closed. Thus, when the switch valve 220 is opened during injection to allow the discharge hole of the discharge valve provided in the degassing unit 12 and the vacuum tank 222 to communicate with each other, the interior of the cavity 8 is decompressed. This allows the involvement of gas into the hot molten metal 11 to be reduced, resulting in further improved quality of formed parts.

In the above-mentioned embodiment, it has been disclosed that only one degassing unit 12 is provided to jointly connect the discharge passage from the upper end of the rim portion 8*b* and the discharge passage from the lower end thereof to the degassing unit 12. Instead of this implementation, two degassing units 12 may be provided to connect the upper and lower ends of the rim portion 8*b* to the degassing units 12 using different discharge passages, respectively. In addition, while there has been illustrated the example that the present invention has been implemented to the vertical die casting machine, the present invention can be also implemented to the injection forming machine for plastics.

As apparent from the foregoing description, the metal mold for forming disk wheels according to this embodiment is implemented to provide discharge passages at the upper and lower portions of the disk wheel rim equivalent portion, respectively to connect these discharge passages to the degassing unit provided in association with the metal mold, thus to discharge gas within the metal mold cavity through the degassing unit at the same time. Accordingly, this eliminates the possibility that gas within the metal mold cavity cannot be discharged because it is locked in the molten metal, thus making it possible to reduce to much extent occurrence of nests within formed parts due to the gas involvement as compared with the prior art, resulting in improved quality of formed part.

A fourth preferred embodiment of the present invention will be now described. As will be understood from the following description, this embodiment contemplates provision of a metal mold for forming disk wheels, provided with a cavity into which molten material is injected from the downward direction toward the direction of the vertical mold shaft, wherein the metal mold is characterized in that a plurality of grooves substantially equidistantly arranged in a circumferential direction are provided at least one of a disk wheel rim equivalent portion and a disk wheel disk equivalent portion of the cavity.

Namely, as previously mentioned, the upper surface of the projection of the fixed metal mold 2 forms the disk portion 8*a* of the cavity 8 and the outer circumferential surface thereof forms the rim portion 8*b* of the cavity 8. In this embodiment, two sets of plural grooves are provided in the upper surface and the outer circumferential surface of the projection of the fixed metal mold 2, respectively. More particularly, one set of plural grooves 8*c* are provided in a manner that they are opened from positions substantially equidistantly divided in a circumferential direction of the above-mentioned upper surface of the projection of the fixed metal mold and gradually become deeper toward the rim portion 8*b*, i.e., in a radial direction. The other set of plural grooves 8*d* are provided in a manner that they communicate with the one set of grooves 8*c* and gradually become shallower in a downward direction.

The operation for forming disk wheels using the injection apparatus thus configured will be now described. After the injection sleeve 9 into which the hot molten metal 11 has been delivered is inserted into the sleeve hole of the fixed metal mold 2 to open the discharge valve of the degassing unit 12, when the plunger chip 10 is advanced, the hot molten metal 11 is thrusted up wthin the injection sleeve 9 to reach the disk portion 8*a*. Then, the hot molten metal 11 flows with it being divided in a radial direction, thereafter flows downwardly through the rim portion 8*b* by the weight of itself. In this case, plural sets of the grooves 8*c* and 8*d* communicating with each other are provided, whereby the hot molten metal 11 separately flows through the grooves 8*c* and 8*d* on the average. Namely, it flows with its flow path being specified by the grooves 8*c* and 8*d*. When the injection of the hot molten metal 11 is continued, the hot molten metal 11 which has reached the lower end of the groove 8*d* overflows from the groove 8*d* to the lower end of the rim portion 8*b*. Thus, it is gradually filled up from the lower end toward the upper end of the rim portion 8*b*. Accordingly, there is no possibility that an undesirable space is formed, with the result that gas within the rim portion 8*b* is thrusted up without being locked in. Thus, the gas which has been thrusted up is discharged to the atmosphere from the discharge valve of the degassing unit via the annular portion of the upper end of the rim portion 8*b* and the degassing groove, or is evacuated by the vacuum unit provided in association with the degassing unit 12. The subsequent operation is the same as that of the above-mentioned embodiment and therefore its detailed description will be omitted.

In addition, a further grooved metal mold structure as described below may be implemented. Namely, the cavity 8 is inversely disposed in a manner that the disk portion 8*a* is directed downwardly and the rim portion 8*b* extends upwardly therefrom. A plurality of grooves which graudally incline from the disk portion toward the lower end of the rim portion are provided at positions substantially equidistantly divided in a circumferential direction of the upper surface of the projection of the fixed metal mold 2, which forms the disk portion 8*a* of the cavity 8. Thus, the same advantages obtained with the embodiment shown in FIG. 13 will be obtained.

Also in this embodiment it is of course that a vacuum unit may be provided in association with the degassing unit for the purpose of providing further improved quality of formed parts.

Figure 13:
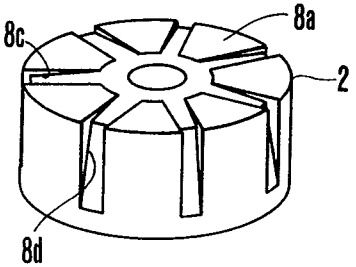
FIG. 13 is a perspective view illustrating a modified example of a projection of a fixed metal mold employed in the present invention.
Figure 2:
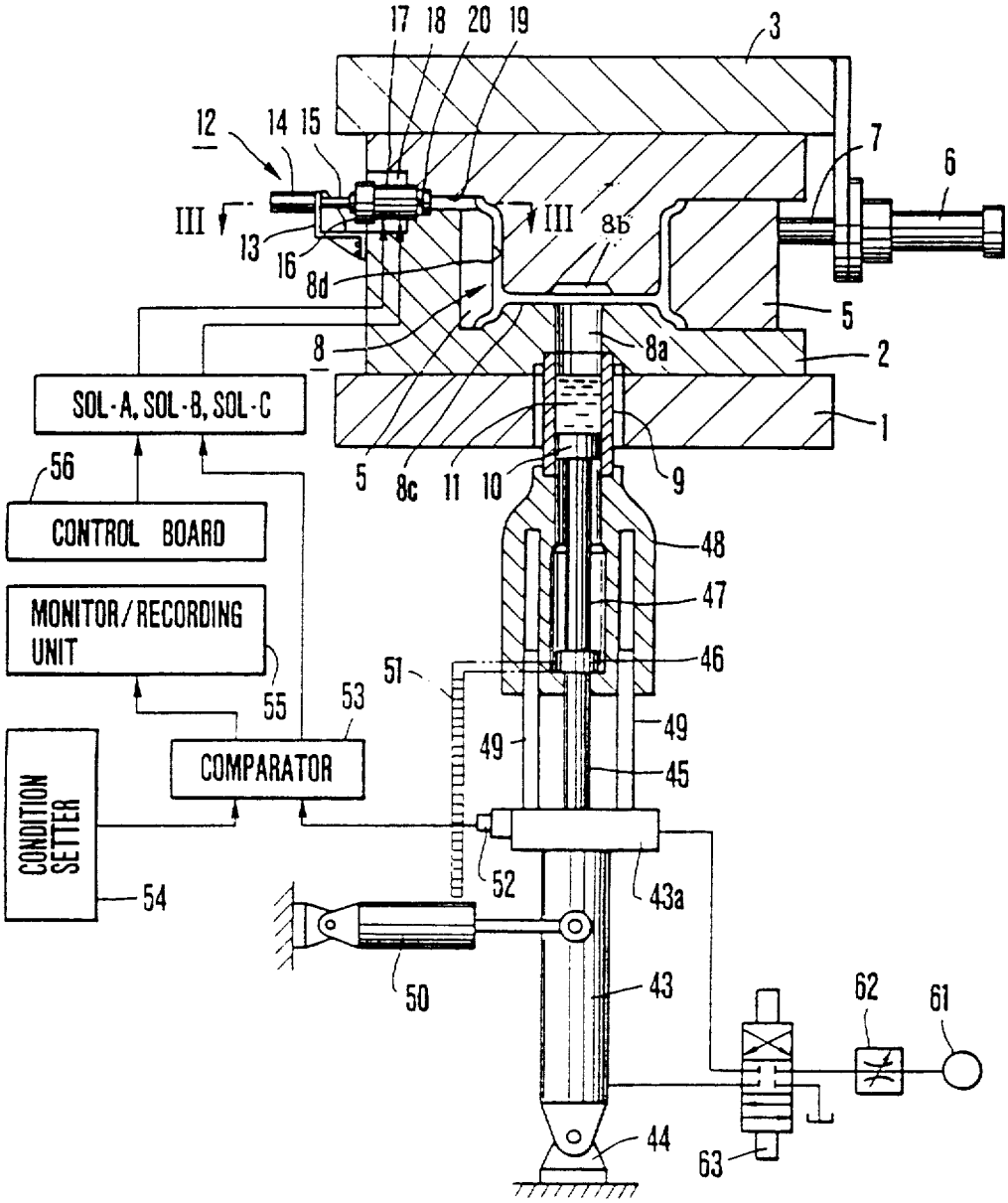

While it has been described in the embodiment shown in FIG. 13 that the grooves 8*c* and 8*d* are provided on the sides of the disk portion 8*a* and 8*b*, respectively, only the groove 8*d* on the side of the rim portion 8*b* may be provided. Moreover, while it has been described that this embodiment is applied to the vertical die casting machine, it is applicable to the injection forming machine for plastics in the same manner. In addition, either the structure comprising two grooves communicating with each other as shown in FIG. 13 or the structure of the unity groove type having referred to as its modification may be suitably applied to various metal molds according to need. Namely, for example, the structure of the unity groove may implemented to the metal mold placed in condition shown in FIG. 13, or the structure of the communicating groove type may be applied the inverted metal mold.

As apparent from the foregoing description, in accordance with this embodiment, there is provided a metal mold for forming disk wheels, provided with a cavity into which molten material is injected from the downward direction toward the direction of the vertical mold shaft wherein a plurality of grooves substantially equidistantly arranged in a circumferential direction are provided on the side of at least one the disk wheel rim equivalent portion and the disk wheel disk equivalent portion of the cavity. Thus, the molten material which is thrusted up by the plunger chip and flows within the cavity flows into respective grooves with it being uniformly separated and is guided to the lower portion of the rim equivalent portion with its flow path being specified. Accordingly, even if the injection is continuously carried out, so that the molten material is moved, there is no possibility that gas is left with it being locked in the lower portion of the rim equivalent portion on the like. Thus, occurrence of nests within formed parts produced due to involvement of gas into the molten material is reduced, resulting in greatly improved quality of the formed parts.

What is claimed is:

1. A method for forming a molded metal part in the shape of a disk wheel comprising:

(a) placing the mold axis of a metal mold cavity in a vertical direction which corresponds to the axis of rotation of said disk wheel, injecting molten metal into said cavity from the bottom of said cavity in the direction of said axis; and (b) controlling the injection speed by a process comprising:

(i) injecting said molten metal at a designated first injection speed when said molten metal has reached the inlet of said cavity;

(ii) injecting said molten metal at a second injection speed which is lower than or equal to said first injection speed and which corresponds to a gas discharge ability of a degassing unit provided in association with said metal mold, from the time when said molten metal passes a disk wheel hub equivalent portion of said cavity until it passes the greater part of a disk wheel rim equivalent portion of said cavity; and (iii) closing the valve of said degassing unit to prevent the discharge of gas from said cavity into the atmosphere after said molten metal has passed the greater part of said rim equivalent portion, allowing said molten metal to completely fill said cavity.

2. A method as set forth in claim 1, wherein a valve closing signal is delivered to said degassing unit after said molten metal has passed the greater part of said rim equivalent portion, to close said discharge valve of said degassing unit.

3. A method as set forth in claim 1, wherein after said molten metal has passed the greater part of said rim equivalent portion, said injection speed is increased, causing said molten metal to exert a force on said discharge valve of said degassing unit, causing said discharge valve to close.

4. A method as set forth in claim 1, wherein during the time period from when said molten metal passes said disk wheel hub equivalent portion of said cavity until it passes the greater part of said disk wheel rim equivalent portion of said cavity, said second injection speed varies stepwise substantially in correspondence with changes in the respective cross-sections of said cavity.

5. A method as set forth in claim 1, wherein gas within said cavity is vacuum-discharged to the air through a discharge hole provided in said degassing unit and coupled to a vacuum unit.

6. A method as set forth in claim 1, wherein before said molten metal reaches said inlet of said cavity, injection is carried out at a speed low enough so that the surface of said molten metal is not disturbed, and at a temperature high enough to prevent premature solidification of said molten metal.

* * * * *

UNITED STATES PATENT AND TRADEMARK OFFICE

CERTIFICATE OF CORRECTION

PATENT NO. : 4,760,874

DATED : August 2, 1988

INVENTOR(S) : Takeshi Mihara

It is certified that error appears in the above-identified patent and that said Letters Patent is hereby corrected as shown below:

The title page showing the illustrative figure should be deleted to appear as per attached page.

Figure 2 should appear as shown on the attached sheet.

Signed and Sealed this

Twenty-fifth Day of July, 1989

*Attest:*

*Attesting Officer*

DONALD J. QUIGG

*Commissioner of Patents and Trademarks*

United States Patent [19]

Mihara

[11] Patent Number: 4,760,874

[45] Date of Patent: Aug. 2, 1988

[54] METHOD AND APPARATUS FOR FORMING DISK WHEEL LIKE FORMED PARTS

[75] Inventor: Takashi Mihara, Ube, Japan

[73] Assignee: UBE Industries, Ltd., Japan

[21] Appl. No.: 23,820

[22] Filed: Mar. 9, 1987

[30] Foreign Application Priority Data

Apr. 16, 1986 [JP] Japan ..... 61-86078
Apr. 16, 1986 [JP] Japan ..... 61-86079
Dec. 1, 1986 [JP] Japan ..... 61-284219

[51] Int. Cl.[4] ..... B22D 17/32

[52] U.S. Cl. ..... 164/457; 164/113; 164/305

[58] Field of Search ..... 164/305, 410, 312, 113, 164/253, 155, 157, 457; 425/420, 812

[56] References Cited

U.S. PATENT DOCUMENTS 4,660,620 4/1987 Oneki ..... 164/155

FOREIGN PATENT DOCUMENTS 1302161 5/1970 Fed. Rep. of Germany ..... 164/113
59-197369 11/1984 Japan ..... 164/457

*Primary Examiner*—Kuang Y. Lin
*Attorney, Agent, or Firm*—Darby & Darby

[57] ABSTRACT

There are disclosed a method and an apparatus for forming disk wheel like formed parts, in a manner that the forming work is carried out by placing, in the vertical direction, the mold axis of a metal mold cavity, which corresponds to the axis of rotation of a disk wheel, thus to inject hot molten metal from the bottom in the mold axis direction, characterized in that the control mode of the injection speed comprises: a first phase to allow an injection speed when the hot molten metal has reached the inlet of the metal mold cavity to be low, a second phase to allow an injection speed from the time when the hot molten metal passes a disk wheel hub equivalent portion of the metal mold cavity until it passes the greater part of a disk wheel rim portion thereof via a disk wheel disk portion thereof to be, at the end portion of said rim equivalent portion, equal to a speed corresponding to a lower speed or less, which corresponds to a gas discharge ability of a degassing unit provided in association with the metal mold, and a third phase to close a discharge valve of the degassing unit after the hot molten metal has passed the greater part of the rim equivalent portion to continuously carry out injecting operation, thus allowing the hot molten metal to be completely filled up into the metal mold cavity. Thus, this permits gas within the metal mold cavity to be effectively discharged at any time without causing gas to be involved into hot molten metal, thus making it possible to easily provide nest-free, high quality formed parts.

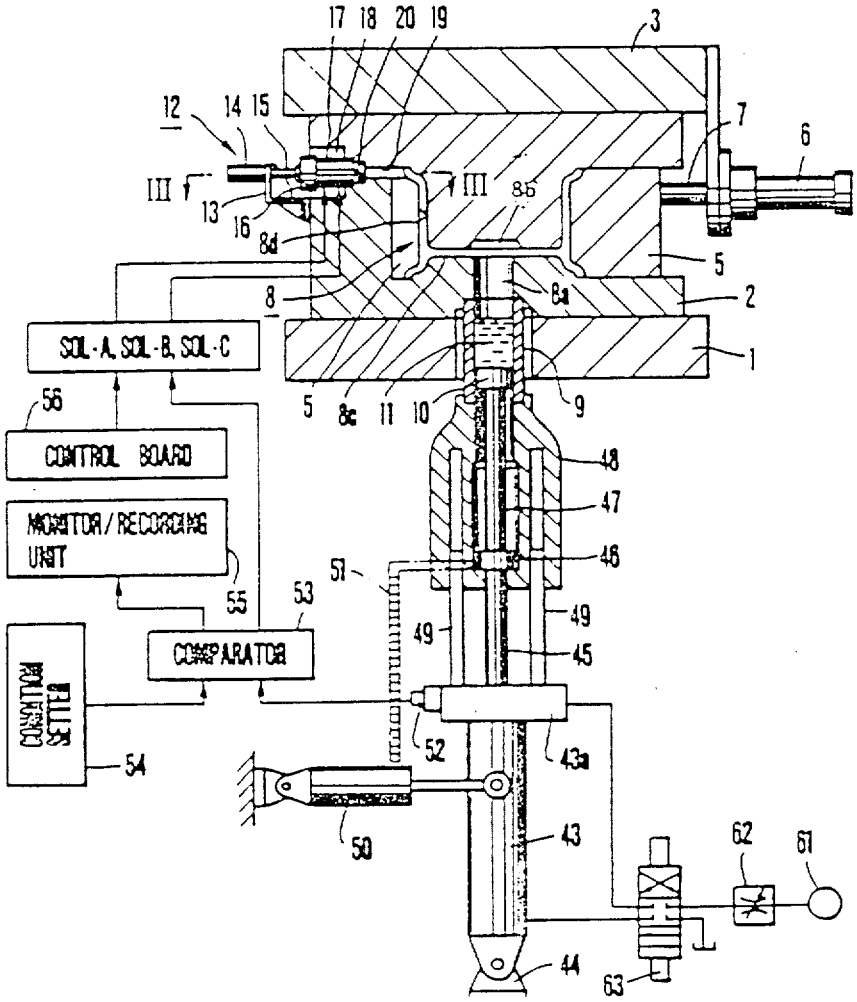

6 Claims, 18 Drawing Sheets